US008753132B2

(12) United States Patent
Scritzky et al.

(10) Patent No.: US 8,753,132 B2
(45) Date of Patent: Jun. 17, 2014

(54) EURO POWER PLUG

(71) Applicant: Apple Inc., Cupertino, CA (US)

(72) Inventors: Robert Scritzky, Sunnyvale, CA (US); Paul Z. Yuan, San Jose, CA (US); Min Chul Kim, Santa Clara, CA (US); Nathan N. Ng, Fremont, CA (US)

(73) Assignee: Apple Inc., Cupertino, CA (US)

( * ) Notice: Subject to any disclaimer, the term of this patent is extended or adjusted under 35 U.S.C. 154(b) by 5 days.

(21) Appl. No.: 13/657,449

(22) Filed: Oct. 22, 2012

(65) Prior Publication Data

US 2014/0113466 A1 Apr. 24, 2014

(51) Int. Cl.
*H01R 3/00* (2006.01)

(52) U.S. Cl.
USPC ..... 439/106

(58) Field of Classification Search
USPC ..... 439/106, 103
See application file for complete search history.

(56) References Cited

U.S. PATENT DOCUMENTS 6,290,533 B1 * 9/2001 Major ..... 439/490
6,328,581 B1 * 12/2001 Lee et al. ..... 439/106
7,040,931 B1 * 5/2006 Achtner et al. ..... 439/651
7,094,085 B2 * 8/2006 Bona et al. ..... 439/172
7,204,727 B2 * 4/2007 Germani ..... 439/835
7,320,613 B1 * 1/2008 Ratzlaff ..... 439/345
7,517,234 B2 * 4/2009 Akino ..... 439/106
7,824,195 B1 * 11/2010 Yu et al. ..... 439/103
2005/0239305 A1 * 10/2005 Akino ..... 439/106

* cited by examiner

*Primary Examiner* — Gary Paumen

(74) *Attorney, Agent, or Firm* — Kilpatrick Townsend & Stockton LLP

(57) ABSTRACT

Power plugs that provide reliable functionality, may be reliably manufactured, and have a pleasant appearance. One example may provide a power plug that functions in a reliable manner by providing a ground connection that may maintain its shape over several insertions and removals from a wall socket. A relatively large ground block may act as a heat sink to help reduce plug temperature during operation. Another example may provide a power plug that may be reliably manufactured by forming the ground block as a solid piece to prevent buckling and bending during plug manufacturing that may otherwise result. Another example may provide a power plug that has an attractive appearance by employing a bridge having a flat surface such that after an overmold is formed over the bridge, a face of the plug has a resulting flat, smooth appearance.

20 Claims, 14 Drawing Sheets

EURO POWER PLUG

BACKGROUND

Electronic devices often receive power from a wall outlet, car power outlet, or other such source. For example, a power plug may include two or more prongs that fit into openings in a wall outlet. The prongs of the plug may connect to conductors in a cord that connects to the electronic device. Power may thus be provided from the wall outlet to the electronic device.

Different regions and counties may have individual infrastructures each having their own protocols for providing power at wall outlets. These protocols may involve different voltages being provided by the wall outlets as well as different physical connections for receiving power from the outlets. For example, the United States may use two flat prong or blade power connections to receive 110 Volts, where Europe may use round power prongs to receive 220 Volts.

These power plugs may need to be functionally reliable. It may be very discouraging for a user to have an expensive electronic device become even temporarily unusable due to a defective power plug. Such a failure may also undermine a user's confidence in the device itself, and with the company that manufactured the device.

Also, it is often the case that many millions of devices may be manufactured, each needing a power plug. Even a small failure rate in manufacturing, or yield loss, may result in the loss of large numbers of plugs. Accordingly, it may be useful for these plugs to be designed such that they may be reliably manufactured.

Further, the appearance of these power plugs may inform a user's opinion as to the quality of not just the plug, but of the electronic device itself. A pleasant appearance may go a long way to informing user's appreciation of an electronic device as well as the levels of user satisfaction and enjoyment of the electronic device.

Thus, what is needed are power plugs that provide reliable functionality, may be reliably manufactured, and have a pleasant appearance.

SUMMARY

Accordingly, embodiments of the present invention may provide power plugs that provide reliable functionality, may be reliably manufactured, and have a pleasant appearance.

An illustrative embodiment of the present invention may provide a power plug that functions in a highly reliable manner. This embodiment of the present invention may provide a ground connection that may maintain its shape and functionality over several insertions and removals from a wall socket. This embodiment may also provide a relatively large ground block that may act as a heat sink to help reduce plug temperature during operation, thereby increasing its long-term reliability.

Another illustrative embodiment of the present invention may provide a power plug that may be reliably manufactured. Again, embodiments of the present invention may include a relatively large ground block. This ground block may be formed as a solid piece. Forming this ground block as a solid piece may prevent buckling and bending during plug manufacturing that may otherwise result, for example if sheet metal were used. Also, forming the ground block as a solid piece may eliminate the need for soldering or spot welding in the formation of the ground block.

Embodiments of the present invention may provide an overmold for the ground block in two steps. The ground block may be mated into the back of a plastic piece or bridge. A ground contact may be placed on the ground block such that it resides in an opening between the ground block and the bridge. An inner mold may cover a substantial portion of the ground block and back of the bridge. This inner mold may then provide a seal to protect the ground contact when an overmold is formed around the inner mold, bridge, and ground block.

Another illustrative embodiment of the present invention may provide a power plug that has an attractive appearance. Specifically, a front or face of the bridge may be flat such that after an overmold is formed over the bridge, a face of the plug has a resulting flat, smooth appearance. Embodiments of the present invention may also employ ground contacts having a straight edge. This straight edge is not only visually pleasant but may be less susceptible to distortion over use as other shapes.

Another illustrative embodiment of the present invention may provide a power plug that includes a plurality of power prongs, a ground block having a first terminal to receive a ground conductor, a post, and a second terminal to accept a ground prong, the second terminal having side openings. The power plug may further include a ground contact having contacting portions fit in the side opening of the second terminal of the ground block and a holder for the ground contact, the holder having an opening to fit over the post on the ground block. The plug may further include a bridge having a back side to accept the ground block such that the ground contact is between the bridge and ground block, the bridge including a plurality of side openings, each to accept one of the plurality of power prongs, and a bottom opening to accept the second terminal of the ground block. An inner mold over the back side of the bridge and the ground block may be included, as may an overmold over the bridge and ground block.

Another illustrative embodiment of the present invention may provide a method of manufacturing a power plug. This method may include receiving a ground block, fitting an opening of a ground contact holder over a post on the ground block, fitting contacting portions of a ground contact into openings on a first terminal on the ground block, fitting the ground block into a back side of a bridge, such that the ground contact is between the ground block and the bridge, inserting connecting portions of a first prong and a second prong into openings in the bridge, and attaching power conductors to the connecting portions of the first prong and the second prong and a ground conductor to a second terminal on the ground block. A mold may be provided for handing by a user. Forming the mold may include forming an inner mold over the back side of the bridge, the ground block, the connecting portions of the first prong and the second prong; and portions of the power and ground conductors, and forming an overmold over the inner mold, a face of the bridge, and portions of the power and ground conductors.

Various materials may be used in the manufacturing of power plugs according to embodiments of the present invention. The ground contacts may be formed using stainless steel, spring steel, music wire, copper, copper titanium, phosphor bronze, nickel, or other appropriate material, and they may be plated with copper, nickel, palladium, gold, or other appropriate material. The spring steel may be of the type ASM A228, and may be at least approximately 1 mm wide. The ground block and prongs may be formed of stainless steel or other conductive material. The bridge, inner mold, and overmold may be formed of silicon or silicone, rubber, hard rubber, plastic, nylon, liquid-crystal polymers (LCPs), or other nonconductive material or combination of materials. Power plugs consistent with embodiments of the present invention may provide power paths for electronic devices such as portable computers, laptops, tablets, desktops, all-in-one computers, cell phones, smart phones, media phones, storage devices, portable media players, navigation systems, monitors and other devices.

Various embodiments of the present invention may incorporate one or more of these and the other features described herein. A better understanding of the nature and advantages of the present invention may be gained by reference to the following detailed description and the accompanying drawings.

BRIEF DESCRIPTIONS OF THE DRAWINGS

DESCRIPTION OF ILLUSTRATIVE EMBODIMENTS

Figure 1:
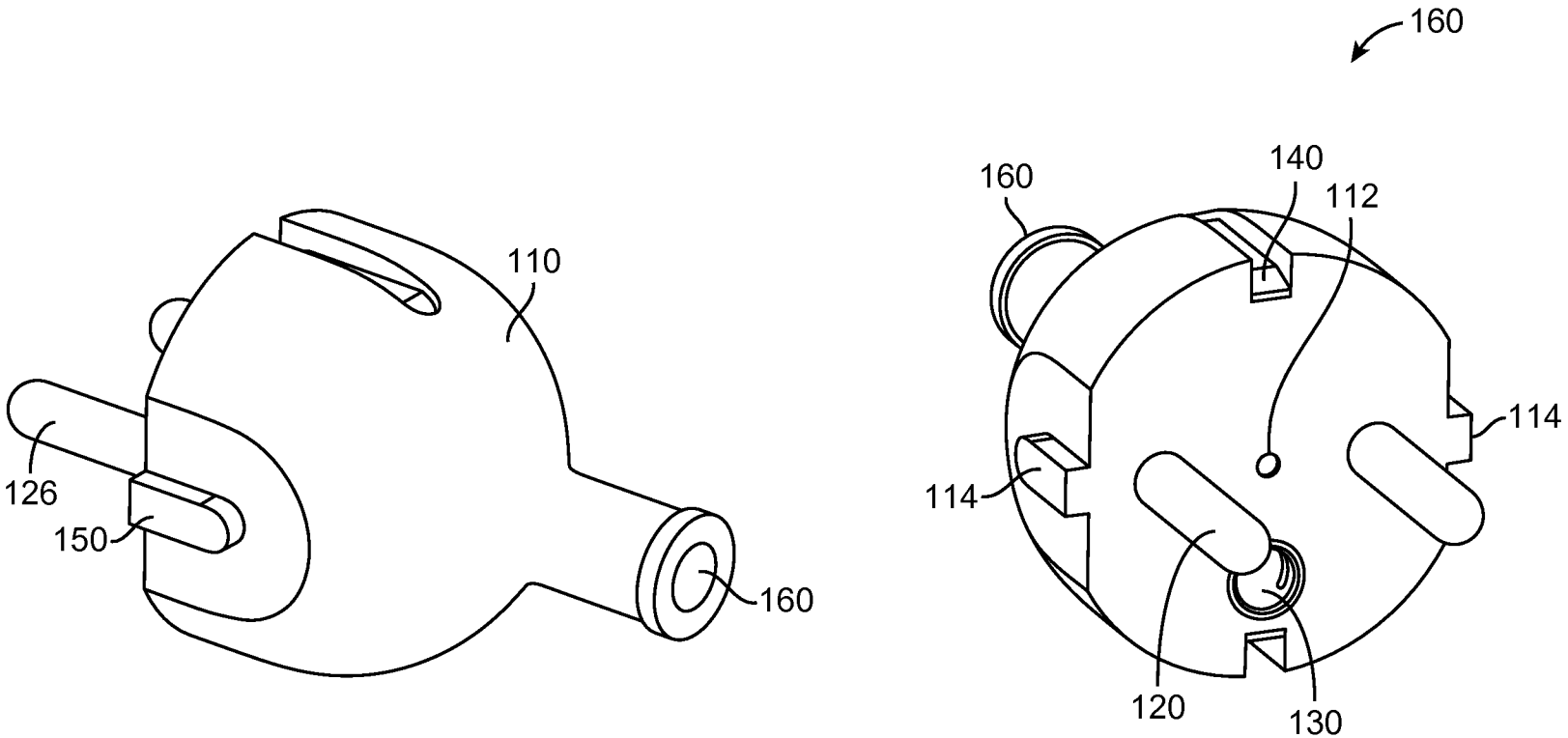
FIG. 1 illustrates oblique views of a power plug consistent with a specific embodiment of the present invention.

FIG. 1 illustrates oblique views of a power plug consistent with a specific embodiment of the present invention. This figure, as with the other included figures, is shown for illustrative purposes only and does not limit either the possible embodiments of the present invention or the claims. Also, the description below may make reference to reference numbers in different figures. To maintain readability, this is not redundantly pointed for each occurrence.

Power plug 100 may include housing or overmold 110 including injection location 112 and raised portions 114, power prongs 120, ground terminal 130 including ground contacts 135, ground terminals 140, and passage 160. Housing or overmold 110 may be formed by injection molding. Specifically, housing or overmold 110 may be formed by injecting material into a mold at location 112. Housing or overmold 110 may include raised portions 114, which may be manipulated by a user when plugging and unplugging power plug 110. Power prongs 120 may receive electrical power from a wall outlet or other power supply. Ground terminal 130 may accept a ground prong at the wall outlet or other source. Ground contacts 140 may also form ground connections at particular outlets. Passage 160 may accept conductors that may attach to ground connections and power prongs of power plug 110.

Again, embodiments of the present invention may provide power plugs that are functionally reliable, may be readily manufactured, and have a pleasant aesthetic appearance. Examples illustrating how these goals may be accomplished according to embodiments the present invention are shown in the following figures.

Figure 2:
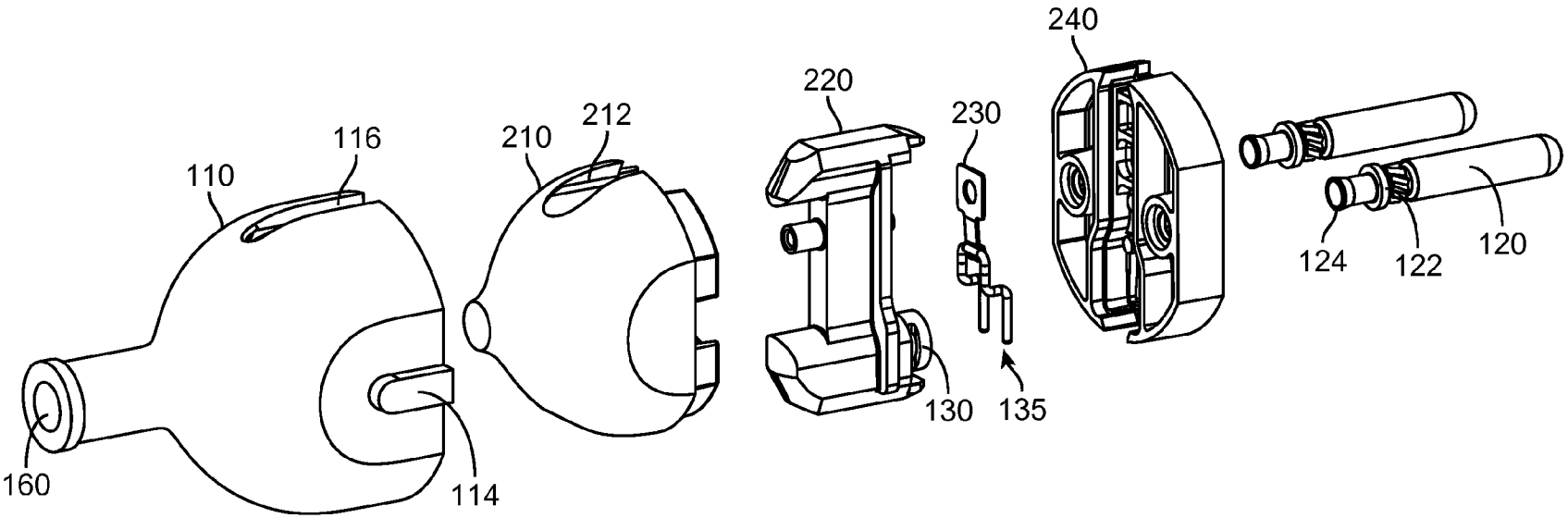
FIG. 2 illustrates portions of a power plug according to an embodiment of the present invention.

FIG. 2 illustrates portions of a power plug according to an embodiment of the present invention. In this figure, ground block 220 may include ground terminal 130 having side openings 132. Ground contact 135 may include, or be connected to, ground contact holder 230. Ground contact holder 230 may fit over a post on ground block 220, and ground contact 135 may fit inside openings 132 of ground terminal 130. Ground block 220, ground contact holder 230, and ground contact 135 may be inserted into central passage 242 in bridge 240. Contacting portions 124 of prongs 120 may be inserted into side passages 244 in bridge 240. Ends of power conductors (not shown) may be inserted contacting portions 124 of prongs 120. A ground conductor may be attached to terminal 222 of ground block 220.

An inner mold 210 may be formed over a back side of bridge 240 and ground block 220. Inner mold 210 may include openings 212 for edges at longitudinal ends of ground block 220. An overmold 110 may include corresponding openings 116 and may be formed over inner mold 210 and front of bridge 240. Overmold 110 may include raised portions 114, which may be held by a user when inserting and removing plug 100.

Again, embodiments of the present invention may provide power plugs that provide reliable functionality. Embodiments of the present invention may provide this reliability by providing a multiple or large ground block 222. This ground block may act as a heat sink allowing the plug to maintain a reasonable temperature during operation. Also, the reliability of the manufacturing process may be improved by providing this ground block 222. Since ground block 222 is solid, it is very difficult to bend or more during the manufacturing process. This in turn may help to increase yields. This ground block is shown in more detail in the following figure.

Figure 3:
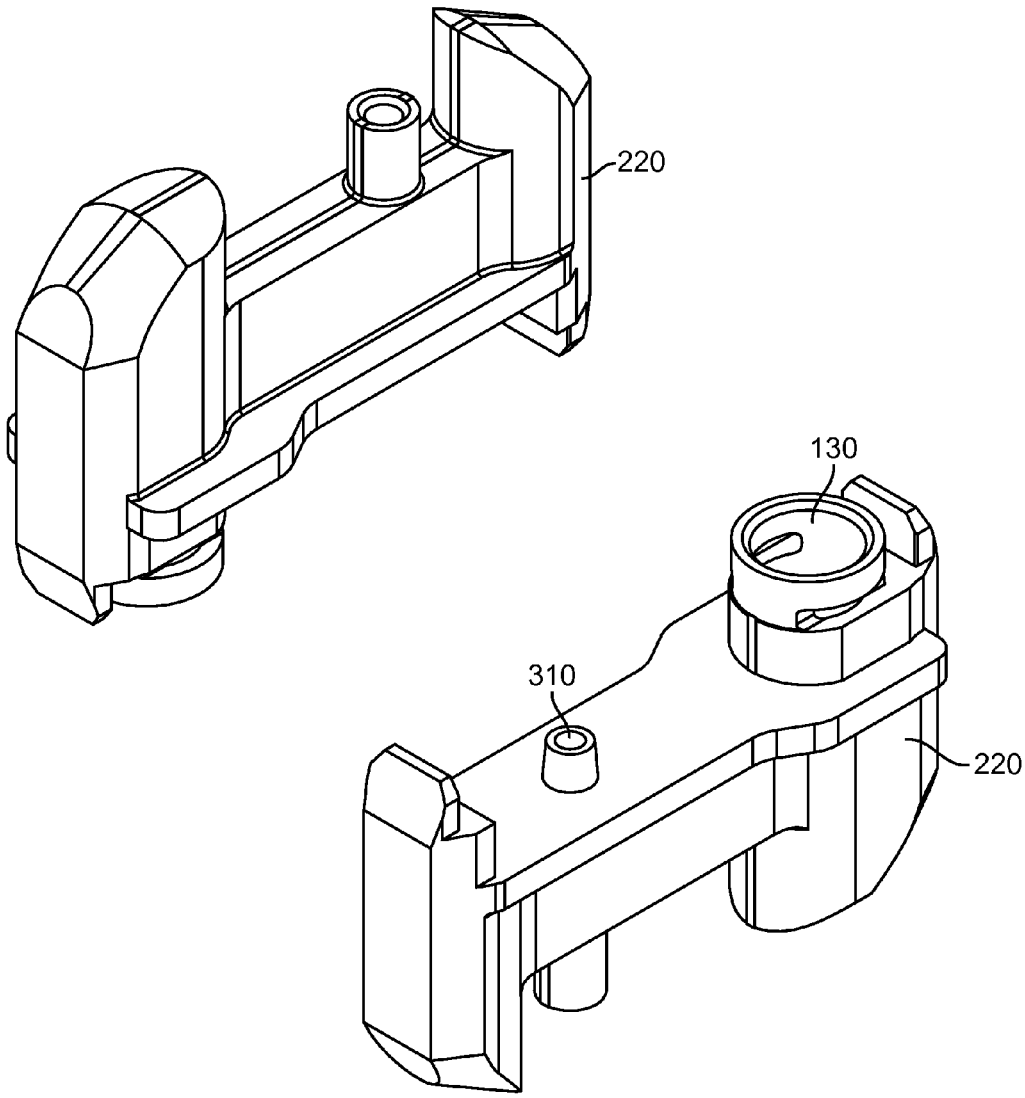
FIG. 3 illustrates a ground block according to an embodiment of the present invention.

FIG. 3 illustrates a ground block according to an embodiment of the present invention. Ground block 220 may include terminal 222 for receiving a ground conductor. Ground block 220 may further include ground terminal 130, which may receive a ground prong on a wall outlet or other power source. Ground terminal 130 may include side openings 132 for accepting ground contact 135 (shown in FIGS. 1 and 2. Again, this description may make reference to reference numbers in different figures. To maintain readability, this is not redundantly pointed for each occurrence.) Post 310 may be included for securing ground contact holder 230. Ground block 220 may be formed of stainless steel or other conductive material.

Ground contacts 135 may fit inside openings 132 of ground terminal 130. Ground contacts 135 and ground terminal 130 may be the subject of rigorous requirements in various jurisdictions. For example, various jurisdictions may require that a certain oversized prong be accepted by ground terminal 130, while ground terminals 135 may need to provide a specific retention force to an undersized ground prong inserted into ground terminal 130. Accordingly, embodiments of the present invention may provide ground contacts that are reliable, are able to maintain that reliability, and provide an attractive appearance. An example is shown in the following figure.

Figure 4:
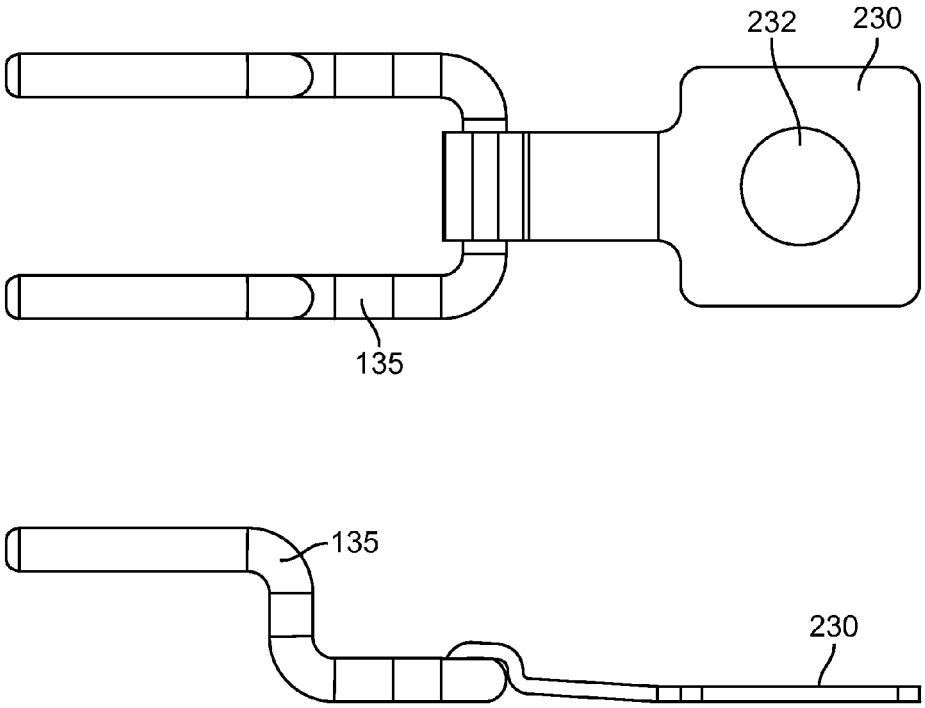
FIG. 4 illustrates a ground contact and ground contact holder according to an embodiment of the present invention.

FIG. 4 illustrates a ground contact and ground contact holder according to an embodiment of the present invention. In this example, ground contact 135 is attached to, or formed as part of, ground contact holder 230. Ground contact holder 230 may include an opening 232. Opening 232 may fit over post 310 of ground block 220. Ground contact 135 may fit inside openings 132 of ground terminal 130 on ground block 220.

In a specific embodiment of the present invention, ground contact 135 may be formed of spring steel or music wire. In a specific embodiment of the present invention, contacts 135 may be formed of ASM A228, and may be approximately 1 mm wide.

Figure 5:
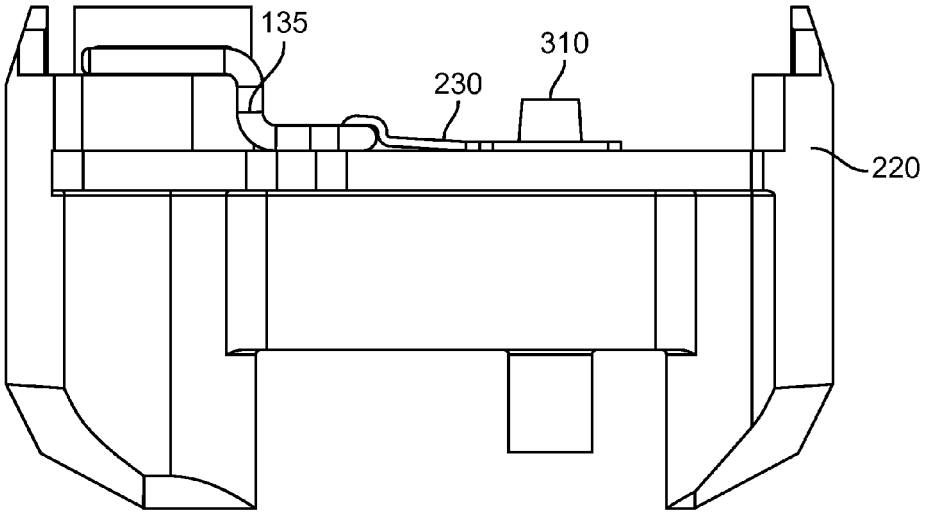
FIG. 5 illustrates a side view of ground block, ground contact holder, and ground contact according to an embodiment of the present invention.

FIG. 5 illustrates a side view of ground block, ground contact holder, and ground contact according to an embodiment of the present invention. Again, ground contact holder 230 may include an opening 232 to fit over post 310 on ground block 220. Ground contact 135 may fit in openings on sides of ground terminal 130 on ground block 220.

Figure 6:
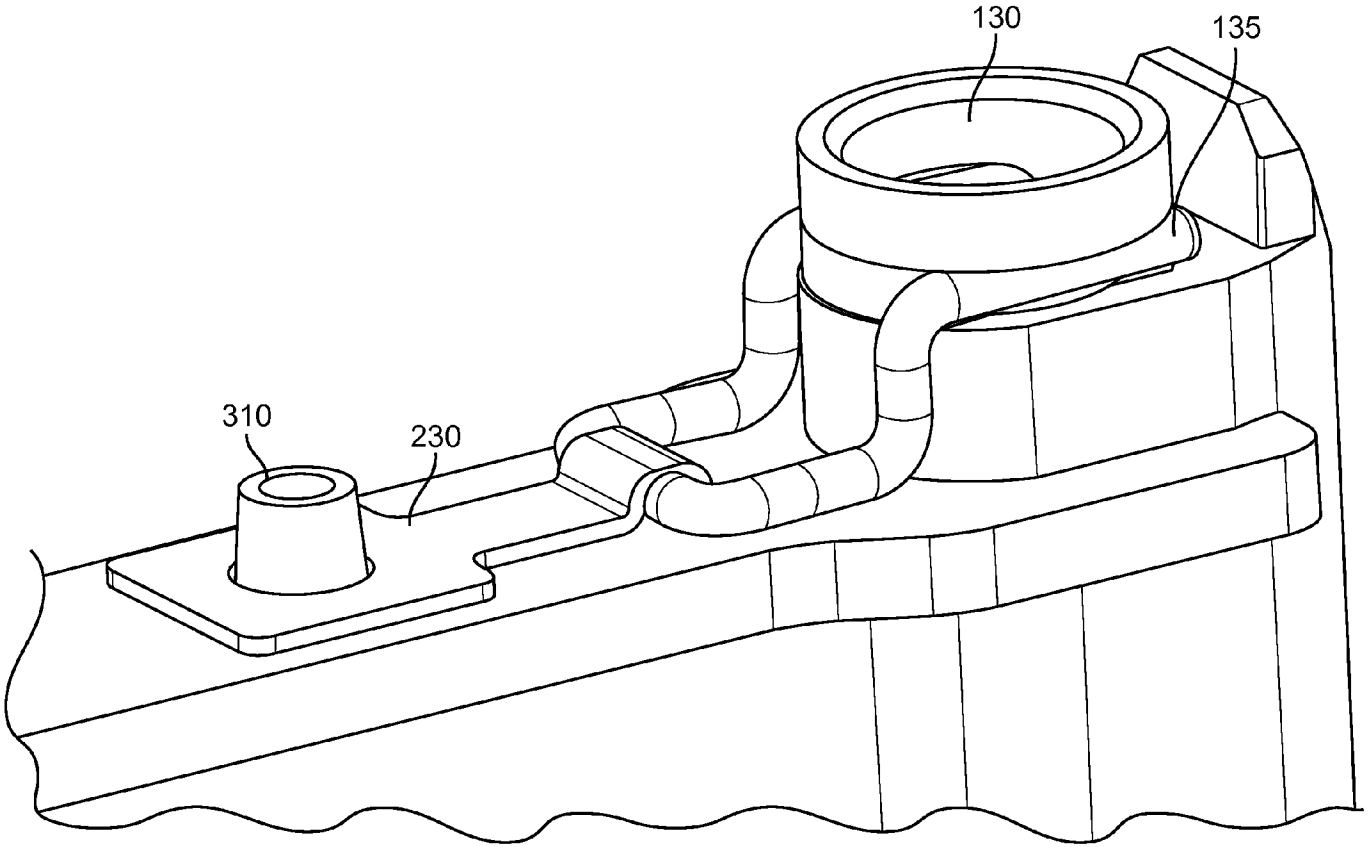
FIG. 6 illustrates an oblique view of a top of ground block, ground contact holder, and ground contact according to an embodiment of the present invention.

FIG. 6 illustrates an oblique view of a top of ground block, ground contact holder, and ground contact according to an embodiment of the present invention. Again, ground contact holder 230 may include an opening 232 to fit over post 310 on ground block 220. Ground contact holder 230 may be formed as part of or attached to ground contacts 135. Ground contact 135 may fit inside openings 132 of ground terminal 130 on ground block 220.

Again, embodiments of the present invention provide power plugs may be reliably manufactured. One way in which this is achieved is to protect ground contact 135 during the formation of the inner mold 210 and overmold 110 portions of the power plug. An example of how this may be accomplished consistent with an embodiment of the present invention is shown in the following figure.

Figure 7:
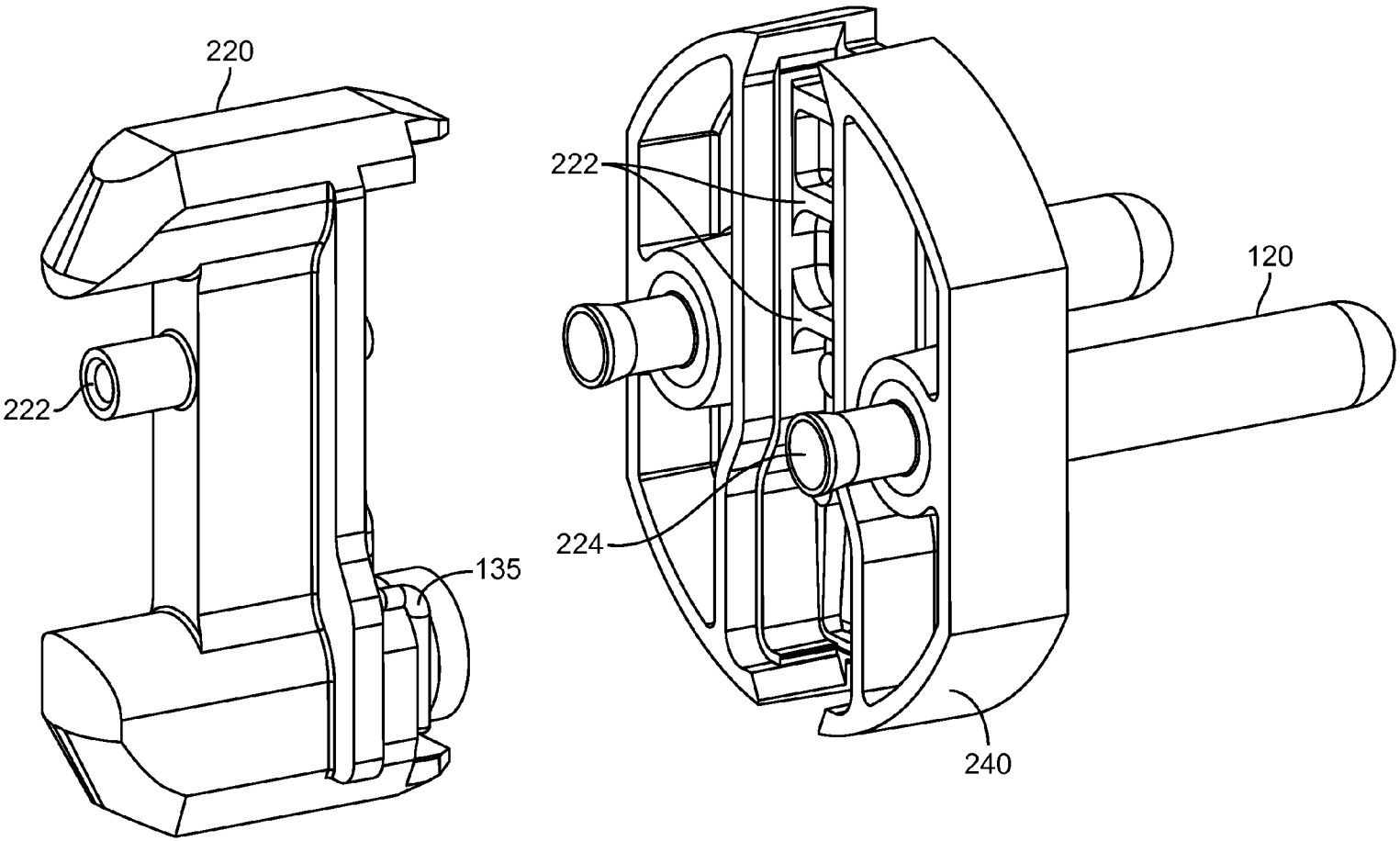
FIG. 7 illustrates a portion of an assembly of a power plug according to an embodiment of the present invention.

FIG. 7 illustrates a portion of an assembly of a power plug according to an embodiment of the present invention. This figure includes ground block 220, power prongs 120, and bridge 240. Bridge 240 includes side passages 224 for accepting prongs 120. Bridge 240 may also include central passage 222 for accepting ground block 220. When ground block 220 is inserted in central passage 222 of bridge 240, ground contact 135 may be in a cavity or chamber surrounded on all sides by either or bridge 240 or ground block 220. This isolation may protect ground contact 135 during the formation of inner mold 210 and overmold 110. Sections 228 may be included to provide rigidity for bridge 240. They may also be provided to help keep ground contact holder 230 and therefore ground contact 135 in place.

Figure 8:
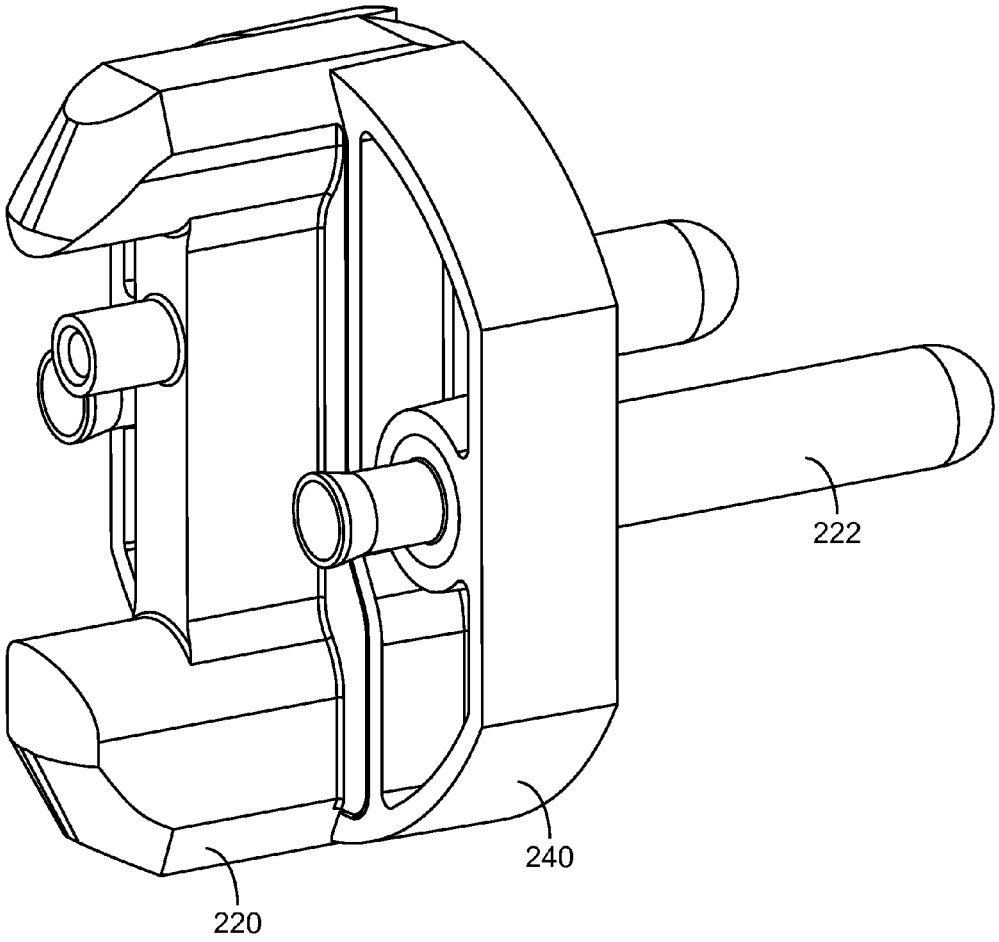
FIG. 8 illustrates a completed assembly of the portion of a power plug according to an embodiment of the present invention.

FIG. 8 illustrates a completed assembly of the portion of a power plug according to an embodiment of the present invention. In this figure, ground block 220 has been inserted into central passage 222 of bridge 240.

Again, embodiments of the present invention may provide power plugs having an attractive appearance. One way this attractive appearance may be achieved is to have a smooth front face of the power plug 100. An example of how this may be accomplished consistent with embodiments of the present invention is shown in the following figure.

Figure 9:
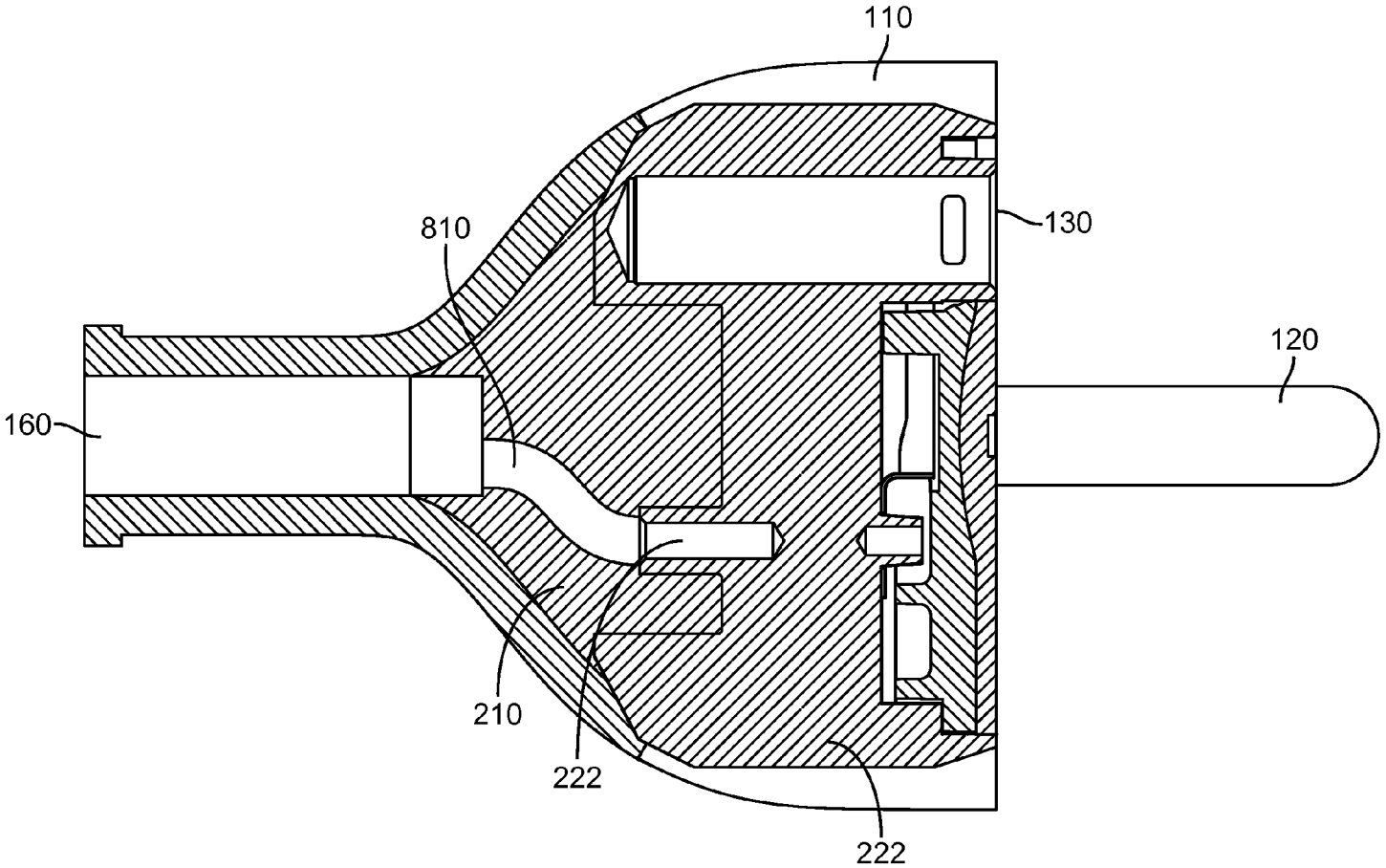
FIG. 9 illustrates a cutaway side view of a power plug according to an embodiment of the present invention.

FIG. 9 illustrates a cutaway side view of a power plug according to an embodiment of the present invention. Power plug 100 may include ground block 220, which may be fitted to bridge 240. Bridge 240 may provide a substantially flat front face. As overmold 110 is formed, the flat face of bridge 240 provides a flat surface for the overmold material, resulting in a smooth front surface of overmold 110, and thereby a smooth front surface of power plug 100.

Again, the molding for power plug 100 may be formed as an inner mold 210 and overmold 110, as shown.

Figure 10:
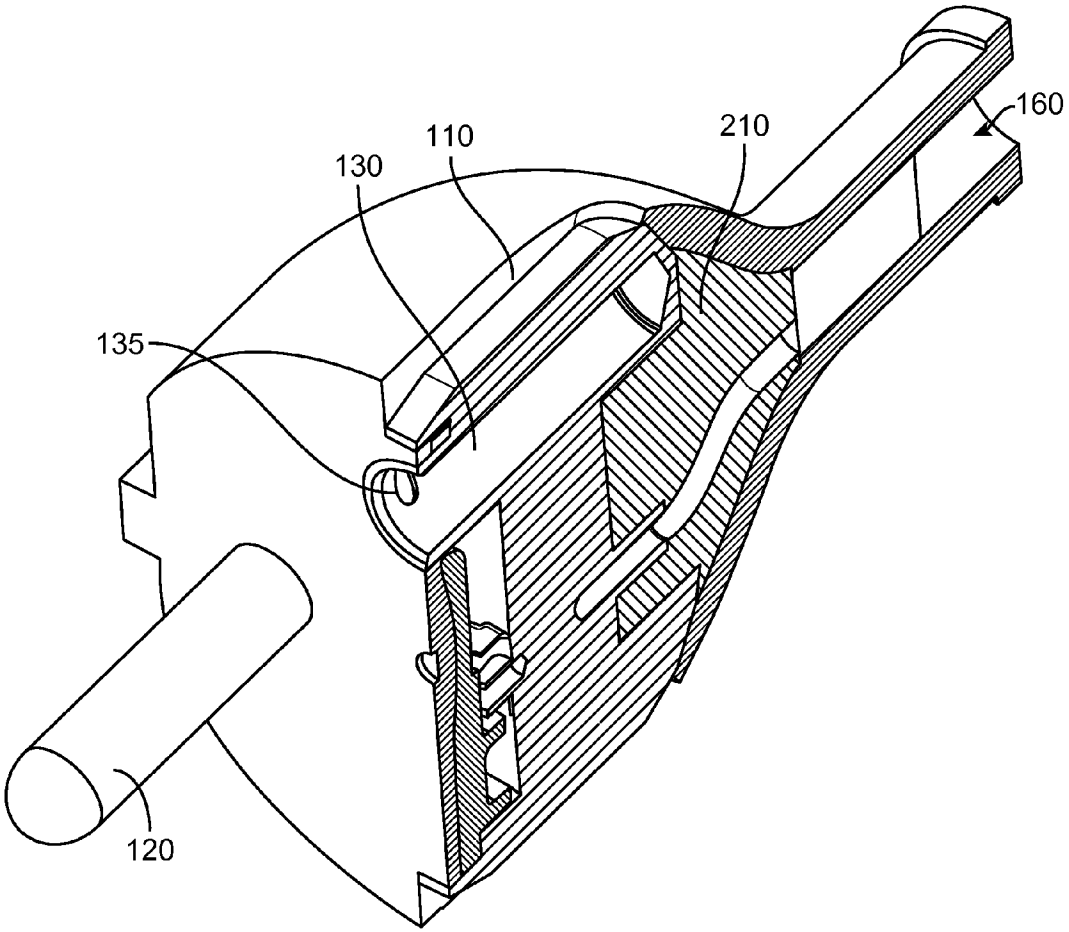
FIG. 10 illustrates another cutaway view of a power plug according to an embodiment of the present invention.

FIG. 10 illustrates another cutaway view of a power plug according to an embodiment of the present invention. Again, overmold 110 may be injected into a mold at location 112. As can be seen, the resulting face of power plug 100 may be substantially flat and smooth.

In other embodiments of the present invention, various components may be manufactured in different ways. For example, the ground contact and ground contact holder may be formed as a single piece. An example of such a power plug is shown in the following figures.

Figure 11:
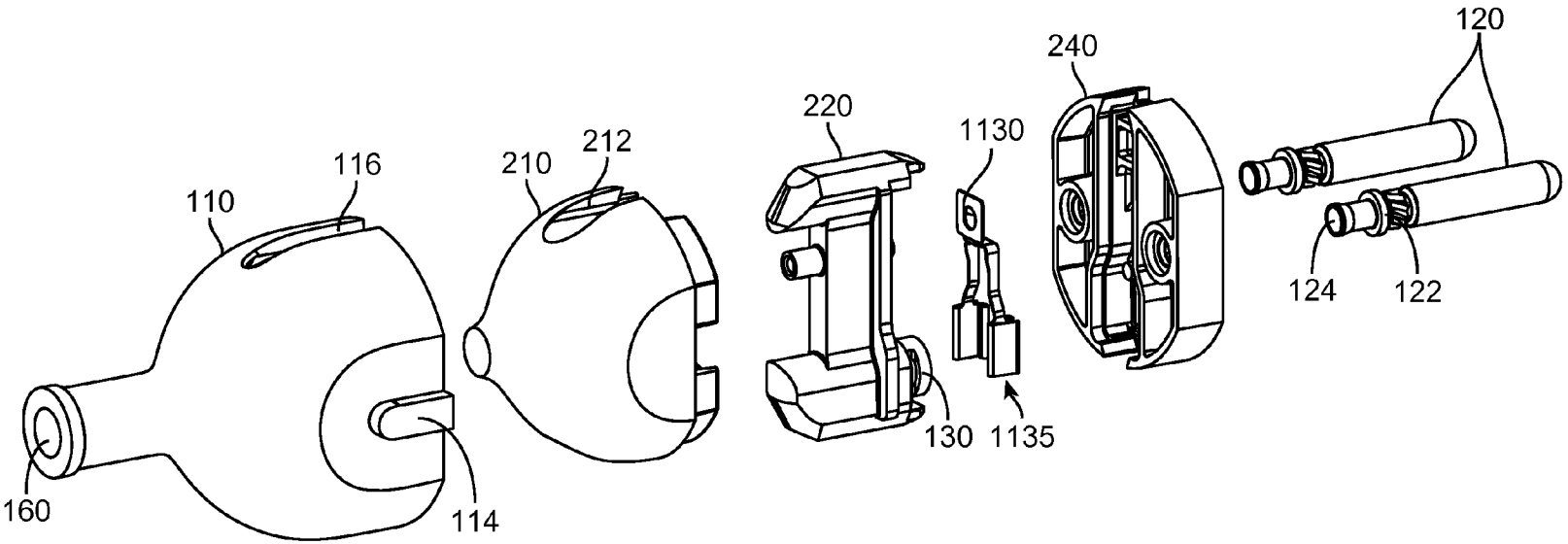
FIG. 11 illustrates portions of a power plug according to an embodiment of the present invention.

FIG. 11 illustrates portions of a power plug according to an embodiment of the present invention. In this example, ground contact 1130 is formed as a single piece with its ground contact holder.

Figure 12:
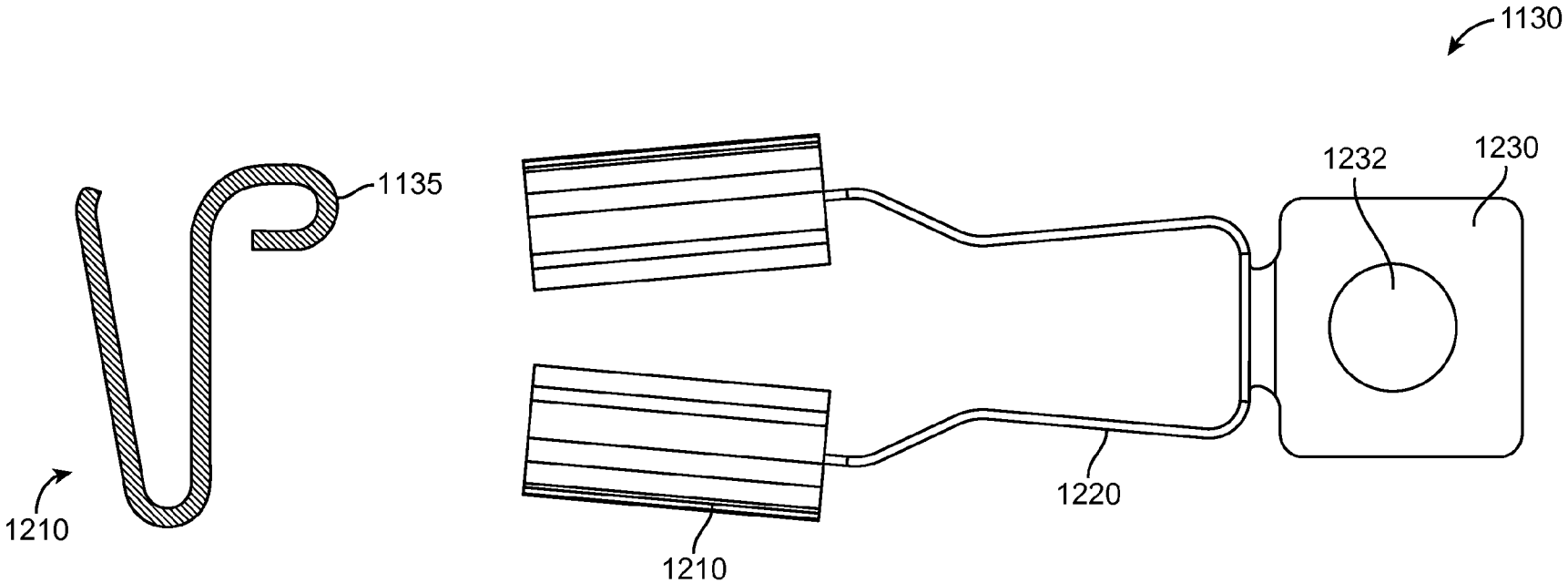
FIG. 12 illustrates a ground contact according to an embodiment of the present invention.

FIG. 12 illustrates a ground contact according to an embodiment of the present invention. Ground contact 1130 may include contacting portions 1210 connected together by connecting piece 1220. Ground contacting portions 1210 may include contacts 1350. Connecting piece 1220 may be attached to holding piece 1230, which may include an opening 1232. Opening 1232 may fit over post 310 on ground block 220, as before.

Figure 13:
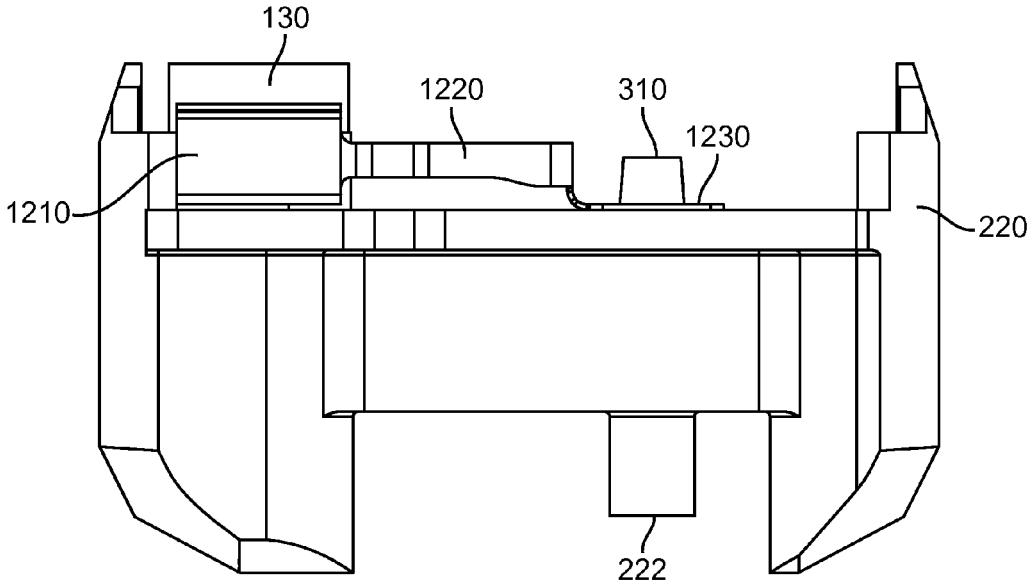
FIG. 13 illustrates a side view of ground block and ground contact according to an embodiment of the present invention.

FIG. 13 illustrates a side view of ground block and ground contact according to an embodiment of the present invention. Holding piece 1230 may include an opening 232 to fit over post 310 on ground block 220. Contacts 1135 may fit in openings 132 on sides of ground terminal 130 on ground block 220.

Figure 14:
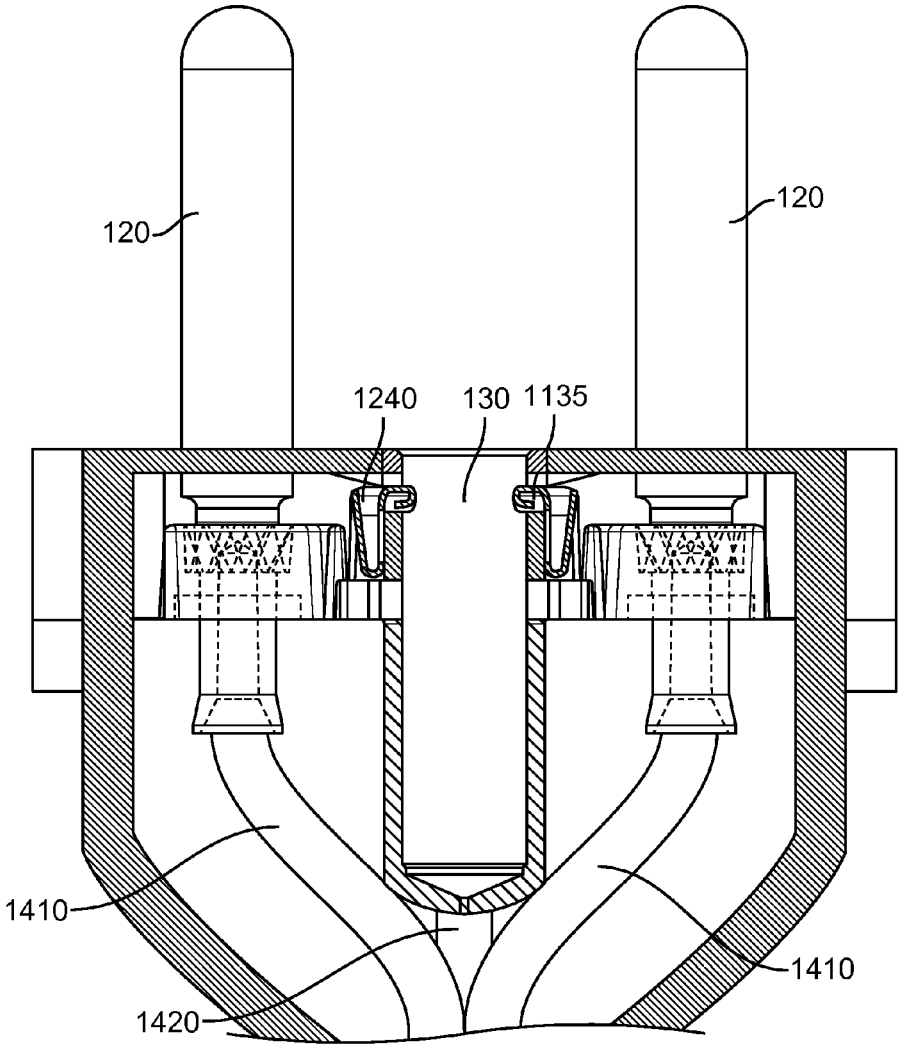
FIG. 14 illustrates a cutaway top view of a power plug according to an embodiment of the present invention.

FIG. 14 illustrates a cutaway top view of a power plug according to an embodiment of the present invention. Power conductors 1410 may connect to prongs 120, while ground conductor 1420 may connect to ground block 220. Contacts 1135 on contacting portions 1210 may be located in the passage in ground terminal 130.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A power plug comprising:

a plurality of power prongs;

a ground block having a first terminal to receive a ground wire and a second terminal to accept a ground prong, the second terminal having side openings;

a ground contact having contacting portions fitting in the side openings of the second terminal of the ground block;

a bridge having a back side to accept the ground block such that the ground contact is between the bridge and the ground block, the bridge including a plurality of side openings, each to accept one of the plurality of power prongs, and a bottom opening to accept the second terminal of the ground block; and an overmold over the bridge and ground block.

2. The power plug of claim 1 wherein the ground block further includes a post and a holder for the ground contact has an opening, the opening fit over the post.

3. The power plug of claim 2 wherein the ground block fits in a central passage of the bridge.

4. The power plug of claim 2 further comprising an inner mold over the back side of the bridge and the ground block.

5. The power plug of claim 2 wherein the bridge has a substantially flat front side.

6. The power plug of claim 1 wherein ground contact is formed of spring steel.

7. The power plug of claim 6 wherein the ground contact is formed using ASM A228 and is approximately 1 mm wide.

8. The power plug of claim 6 wherein the ground block is formed of stainless steel.

9. The power plug of claim 8 wherein the bridge is plastic.

10. A method of manufacturing a power plug comprising:

receiving a ground block;

fitting an opening of a ground contact holder over a post on the ground block;

fitting contacting portions of a ground contact into openings on a first terminal on the ground block;

fitting the ground block into a back side of a bridge, such that the ground contact is between the ground block and the bridge;

inserting connecting portions of a first prong and a second prong into openings in the bridge;

attaching power conductors to the connecting portions of the first prong and the second prong and a ground conductor to a second terminal on the ground block;

forming an inner mold over the back side of the bridge, the ground block, the connecting portions of the first prong and the second prong; and portions of the power and ground conductors; and forming an overmold over the inner mold, a face of the bridge, and portions of the power and ground conductors.

11. The method of claim 10 wherein the ground block is a solid piece of stainless steel.

12. The method of claim 10 wherein fitting the ground block into a back side of a bridge includes fitting the ground block in a central passage of the bridge.

13. The method of claim 12 wherein the bridge is plastic.

14. The method of claim 10 wherein forming an overmold includes forming raised portions on the overmold to be manipulated by a user.

15. The method of claim 10 wherein forming an overmold includes forming openings over ends of the ground block.

16. A power plug comprising:

a plurality of power prongs;

a ground block having a first terminal to receive a ground conductor, a second terminal to accept a ground prong, the second terminal having side openings, and a post;

a ground contact having contacting portions fitting in the side openings of the second terminal of the ground block;

a holder for the ground contact, the holder having an opening to fit over the post on the ground block; and a bridge having a back side to accept the ground block such that the ground contact is between the bridge and the ground block, the bridge including a plurality of side openings, each to accept one of the plurality of power prongs, and a bottom opening to accept the second terminal of the ground block.

17. The power plug of claim 16 further comprising an inner mold over the back side of the bridge and the ground block.

18. The power plug of claim 17 further comprising an overmold over the bridge and ground block.

19. The power plug of claim 16 wherein the ground contact and the holder for the ground contact are formed as separate pieces.

20. The power plug of claim 16 wherein the ground contact and the holder for the ground contact are formed as the same piece.

* * * * *